US006830520B1

(12) United States Patent
Bollar

(10) Patent No.: US 6,830,520 B1
(45) Date of Patent: Dec. 14, 2004

(54) ADJUSTABLE EMBEDDED BAT SPEED INDICATOR

(76) Inventor: Steven Bollar, 1767 Wolverine Way, Vista, CA (US) 92084

( * ) Notice: Subject to any disclaimer, the term of this patent is extended or adjusted under 35 U.S.C. 154(b) by 0 days.

(21) Appl. No.: 10/827,752

(22) Filed: Apr. 21, 2004

(51) Int. Cl.[7] ..... A63B 69/00
(52) U.S. Cl. ..... 473/457; 473/461
(58) Field of Search ..... 473/567, 457, 473/568, 234, 223, 219, 326, 333, 463, 226, 461, 233, 564; 73/493

(56) References Cited

U.S. PATENT DOCUMENTS 3,113,782 A * 12/1963 Guier ..... 473/234
3,136,546 A * 6/1964 Connolly ..... 473/234
3,173,688 A * 3/1965 Green ..... 473/568
4,898,386 A * 2/1990 Anderson ..... 473/457
5,133,551 A * 7/1992 Handy et al. ..... 473/567
5,841,029 A * 11/1998 Luking ..... 73/514.31
6,569,042 B2 * 5/2003 LaChance et al. ..... 473/457

* cited by examiner

*Primary Examiner*—Gregory Vidovich
*Assistant Examiner*—M. Chambers
(74) *Attorney, Agent, or Firm*—Steven W. Webb

(57) ABSTRACT

An improved baseball swing trainer is presented where a standard wooden bat is modified with an embedded magnetic speed indicator based on a ball bearing and a magnet. The distance between the magnet and the ball bearing can be adjusted to adjust the amount of swing force necessary to break the ball bearing free. The device is mechanically simple and easy to install in any wooden bat.

3 Claims, 2 Drawing Sheets

ADJUSTABLE EMBEDDED BAT SPEED INDICATOR

FIELD OF THE INVENTION

This invention relates to stroke and swing force and speed measuring devices, indicators, and the like. Such devices are used with tennis racquets, baseball bats, golf clubs, and other sports equipment to analyze swing speed and force in a variety of modes.

BACKGROUND OF THE INVENTION

Baseball require players to swing a bat with sufficient speed to place a ball in play. Bat speed is directly related to the speed imparted to the baseball when it leaves the bat. Bat speed also indicates the amount of control a player has over the bat while swinging it.

It is possible for a player to "overswing" the baseball bat and lose control of it. Underswinging the bat will not impart sufficient velocity to the struck ball. Finally, optimal bat speed can vary from player to player depending on player size, swing plane, and hitting style. For example, a singles hitter who hits the ball on the ground through the infield needs more control than a power hitter who drives the ball to the outfield wall. These players will need to practice swinging the bat at different bat speeds to work on their games.

There are several stroke force and speed indicators in the current state of the art. U.S. patents to Guier (U.S. Pat. No. 3,113,782), Green (U.S. Pat. No. 3,173,688), Zordan et al. (U.S. Pat. No. 3,137,504), and Connely (U.S. Pat. No. 3,136,546) all show sliding, noisemaking indicator means. Anderson (U.S. Pat. No. 4,898,386) and Handy et al. (U.S. Pat. No. 5,133,551) show baseball-bat-shaped devices with sliding weights. None of these devices show a standard baseball bat with a small attachment embedded in the very end of the bat, or a simplified adjustment means.

OBJECTS OF THE INVENTION

It is an object of this invention to provide an improved baseball bat speed indicator that makes a distinctive sound when the desired bat speed is reached.

It is a further goal of this invention to produce a bat speed indicator that is simple to manufacture.

It is a further goal of this invention to produce a bat speed indicator that is easily adjustable by hand or with simple tools.

It is a further goal of this invention to produce a bat speed indicator that can be installed in any wooden bat with a minimum amount of labor.

SUMMARY OF THE INVENTION

The present invention is a set of simple parts that can be installed in a standard baseball bat by drilling three holes. Once the holes are drilled, a simple cylindrical magnetic mechanism, three wood screws, a ball bearing, and an adjustment knob are inserted and screwed down. The adjustment knob at the end of the bat inside the bat head allows the position of the ball bearing vis a vis the magnet to be set, determining how much swing force is needed to make the ball travel the cylinder and make a clicking sound when it strikes the and of the cylinder.

BRIEF DESCRIPTION OF THE DRAWINGS

The features of this invention will be best understood from the accompanying drawings, taken in conjunction with the accompanying description.

DESCRIPTION OF THE PREFERRED EMBODIMENT

Figure 1:
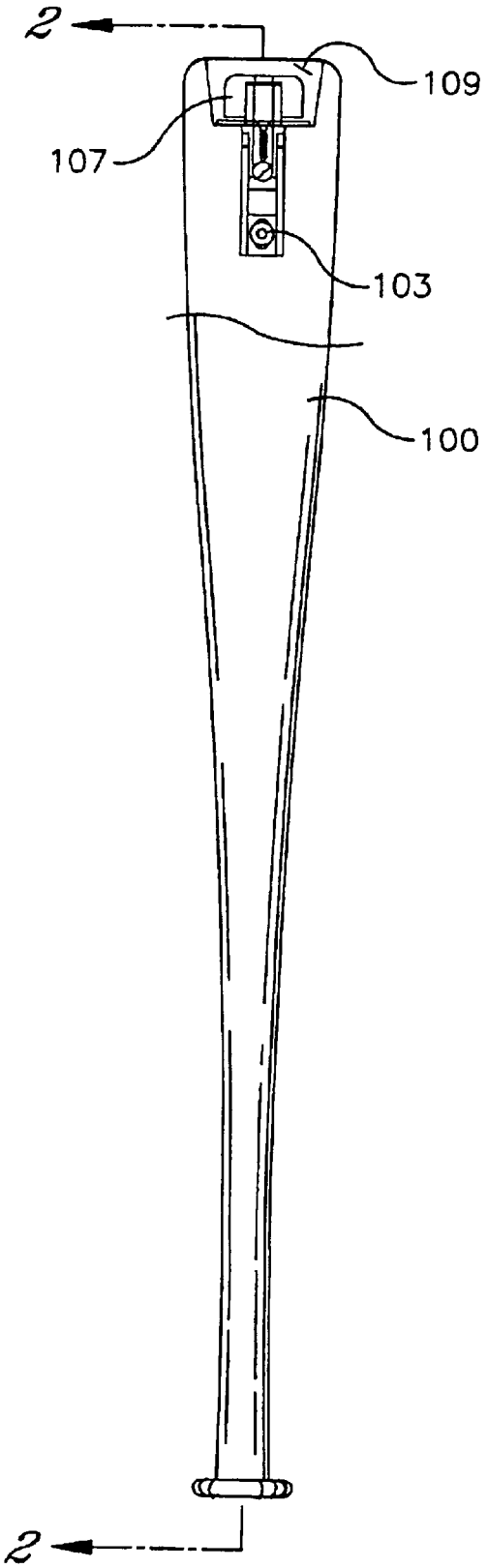
FIG. 1 is a side view of the bat showing the placement of the invention.
Figure 2:
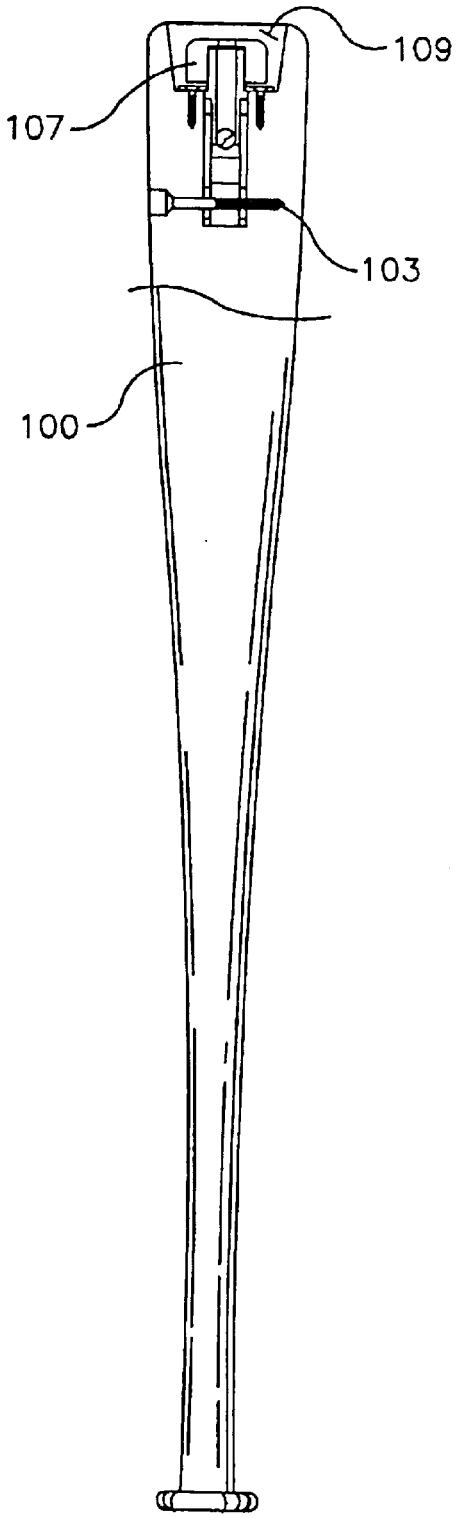
FIG. 2 is another side view of the bat rotated 90 degrees
Figure 3:
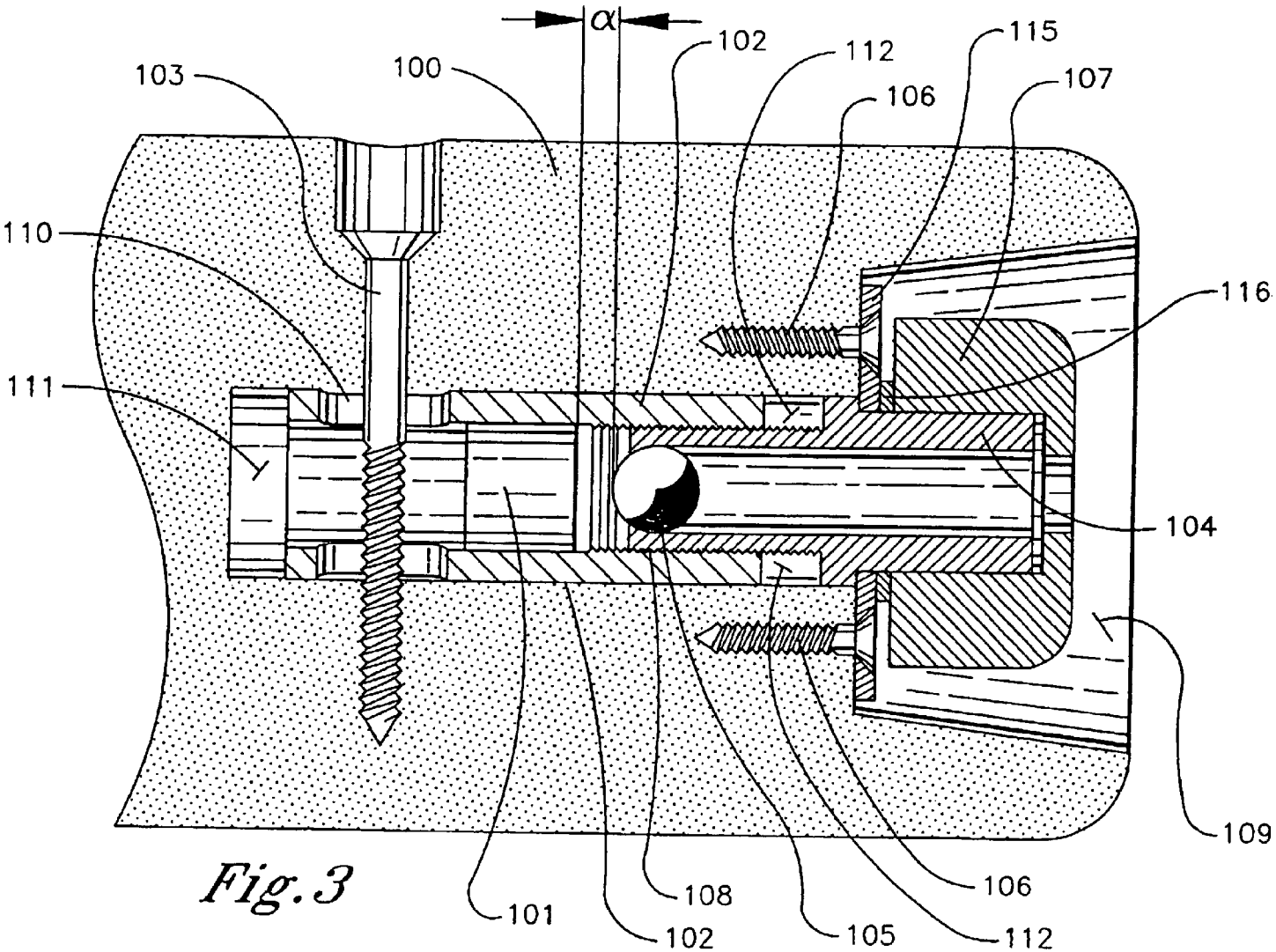
FIG. 3 is a close up of the bat head showing the invention.

The invention can be seen best in FIG. 3, and it consists of a modified wooden bat 100, a cylindrical magnet 101, a traveling magnet holder 102, a holding screw 103, a rotating cylinder 104, a ballbearing 105 placed inside the rotating cylinder 104, a plurality of bat head holding screws 106, an adjustment knob 107 attached removably to the rotating cylinder 104, a positioning washer 115 to stabilize the position of the rotating cylinder 104, a felt washer 116 to seal out dirt, and screw threads 108 on the rotating cylinder 104 which engage with the interior wall of the traveling magnet holder 102.

The device is operated by preparing a wooden bat to the configuration shown in the figures, drilling the holes including the truncated conical hole 109 at the end. Then the traveling magnet holder 102 with magnetic 101 is inserted into the long cylindrical hole until the slot 110 in the traveling magnet holder 102 lines up with the holding screw 103. The holding screw 103 is then inserted through the slot 110 and screwed down. The rotating cylinder 104 with ball bearing 105 is then inserted in the traveling magnet holder 102 and screwed in. The positioning washer 115 and felt washer 116 are then slid on. The bat head holding screws 106 are then screwed in, and finally the adjustment knob 107 is attached.

The invention is operated by tuning the adjustment knob 107 in the end of the bat 100 such that the traveling magnet holder 102 slides up and down the cylindrical drilled hole in the bat. Note that the magnet holder slot 110 is wide enough so that the traveling magnet holder 102 can move up and down the drilled hole. Empty spaces 111,112 permit the traveling magnet holder 102 to travel a substantial distance within the drilled hole.

Moving the traveling magnet holder by means of turning the adjustment knob 107 moves the magnet closer to or farther away from the ball bearing 105 in the rotating cylinder 104. When the bat 100 is subsequently swung in practice, the centrifugal force of the swing acting along the long axis of the bat 100 will move the ball bearing 105 away from the magnet 101. Depending on how fast the bat is swung, the centrifugal force will cause the ball bearing 105 to strike the end of the rotating cylinder 104 with a "click" sound. The settings of the adjustment knob 107 can be calibrated with experience in using the bat.

The inventor has noted that there is in practice only a small range of motion for the traveling magnet holder 102 to be adjusted within by means of the adjustment knob 107where the motion of the ball bearing 105 can be affected within the rotating cylinder 104

While the foregoing describes a preferred embodiment, variation on this design and equivalent designs may be resorted to in the scope and spirit of the claimed invention.

What is claimed is:

1. A baseball bat swing trainer, the swing trainer comprised of an industry-standard wooden bat, a longitudinal hole in the bat, a holding means hole in the bat, a magnet, a cylindrical traveling magnet holder, a holding means, a rotating cylinder, a steel ball bearing, a plurality of bat head holding screws, a positioning washer, and an adjustment knob, the longitudinal hole drilled in the end of the bat away from the handle, the longitudinal hole drilled along the center line of the bat head parallel to the bat's long axis, the holding means hole drilled into the side of the bat head perpendicular to the long axis of the bat, the holding means hole intersecting the longitudinal hole, said longitudinal hole possessing a truncated, conical cutout at the end of the bat that permits the adjustment knob to be recessed, the swing trainer assembled by inserting the magnet in the cylindrical traveling magnet holder fixedly, sliding the cylindrical traveling magnet holder into the longitudinal hole, the cylindrical traveling magnet holder possessing a positioning slot, until the positioning slot is fitted over the intersection of the holding means hole with the longitudinal hole, inserting the holding means into the holding means hole until the end of the holding means fits into the slot in the traveling magnet holder, the rotating cylinder possessing screw threads on its outer surface, the cylindrical traveling magnet holder possessing screw threads on its inner surface, the external diameter of the rotating cylinder the same as the internal diameter of the cylindrical traveling magnet holder, the rotating cylinder then inserted into the longitudinal hole and screwed into the cylindrical traveling magnet holder, the steel ball bearing inserted loosely into the rotating cylinder, the positioning washer and a felt washer then slid onto the end of the rotating cylinder not inserted in the cylindrical traveling magnet holder, the adjustment cap then attached fixedly to the end of the rotating cylinder not inserted in the cylindrical traveling magnet holder, the plurality of bat head holding screws then screwed into the end of the longitudinal hole such that they prevent the rotating cylinder from sliding out of the longitudinal hole, the swing trainer used by turning the adjustment knob until the traveling magnet holder is moved far enough away from the steel ball bearing to enable the steel ball bearing to break free of the magnetic field when the swing trainer is swung as a baseball bat.

2. A swing trainer as in claim 1 where the magnet is a rare earth magnet.

3. A swing trainer as in claim 1 where the holding means is a wood screw.

* * * * *